US006822642B2

(12) United States Patent
Chou

(10) Patent No.: US 6,822,642 B2
(45) Date of Patent: Nov. 23, 2004

(54) AUTO-IMPROVING DISPLAY FLICKER METHOD

(75) Inventor: Hsien-Ying Chou, Hsinchu (TW)

(73) Assignee: AU Optronics Corporation, Hsin-Chu (TW)

( * ) Notice: Subject to any disclaimer, the term of this patent is extended or adjusted under 35 U.S.C. 154(b) by 304 days.

(21) Appl. No.: 09/767,955

(22) Filed: Jan. 24, 2001

(65) Prior Publication Data

US 2002/0053999 A1 May 9, 2002

(30) Foreign Application Priority Data

Nov. 4, 2000 (TW) ..... 89123262 A

(51) Int. Cl.[7] ..... G09G 3/36
(52) U.S. Cl. ..... 345/204; 345/99
(58) Field of Search ..... 345/204, 690, 345/87, 99, 102, 213, 76, 78, 94; 315/169.3; 349/61

(56) References Cited

U.S. PATENT DOCUMENTS

| | | | | | |
|---|---|---|---|---|---|
| 5,731,843 | A | * | 3/1998 | Cappels, Sr. | 348/537 |
| 5,771,030 | A | * | 6/1998 | Suzuki et al. | 345/87 |
| 6,141,092 | A | * | 10/2000 | Kim | 356/214 |
| 6,144,373 | A | * | 11/2000 | Nakazawa et al. | 345/204 |
| 6,295,041 | B1 | * | 9/2001 | Leung et al. | 345/89 |
| 6,388,647 | B2 | * | 5/2002 | Leung et al. | 345/88 |
| 6,421,038 | B1 | * | 7/2002 | Lee | 345/98 |
| 6,429,839 | B1 | * | 8/2002 | Sakamoto | 345/87 |

* cited by examiner

*Primary Examiner*—Vijay Shankar
*Assistant Examiner*—Nitin Patel
(74) *Attorney, Agent, or Firm*—Darby & Darby

(57) ABSTRACT

This invention relates to an auto-improving display flicker method to eliminate all possible display flicker effects. The method includes the steps: detecting the display flicker level and producing a detection voltage; comparing the detection voltage with a predetermined voltage; automatically switching the currently used inversion technique into an alternately predetermined display flicker processing technique if the detection voltage is greater than the predetermined voltage.

6 Claims, 3 Drawing Sheets

AUTO-IMPROVING DISPLAY FLICKER METHOD

BACKGROUND OF THE INVENTION

1. Field of the Invention

This invention relates to an improving method for a display, and particularly to an auto-improving flicker method for a LCD.

2. Description of the Related Art

For a display design, a direct current (DC) voltage generally comes from the bad design of the electrical characteristics of a display, for example, lack of a uniform crystal liquid quality for a LCD. The DC voltage easily causes the appearance of a display flicker effect, for example, the flicker around the edge of a frame, thereby making the eyes of users uncomfortable. Typically, the elimination of the flicker effect uses an inversion technique. The inversion technique includes dot inversion, line inversion, column inversion, n lines inversion, and n column inversion. A display conventionally adopts an inversion technique to eliminate the flicker effect. However, each of the inversion techniques has its specific signal pattern incurring a flicker effect. Accordingly, the conventional method cannot overcome all possible flicker effects. For example, when the Windows OS shuts down, a display with dot inversion technique appears to flicker on the frame.

SUMMARY OF THE INVENTION

Therefore, an object of the invention is to provide an auto-improving display flicker method to eliminate all possible display flicker effects.

A further object of the invention is to provide an auto-improving display flicker method, the method using a common electrode as a sensor to detect the display flicker for automatically improving the display flicker on a frame.

To realize the above and other objects, the invention provides an auto-improving display flicker method to eliminate all possible display flicker effects. The method includes the steps: detecting the display flicker level and producing a detection voltage; comparing the detection voltage with a predetermined voltage; automatically switching the currently used inversion technique into an alternately predetermined display flicker processing technique if the detection voltage is greater than the predetermined voltage. The predetermined display flicker processing technique includes dot inversion, line inversion, column inversion, n line inversion, and n column inversion.

Therefore, the invention can automatically improve all the display flicker effects.

BRIEF DESCRIPTION OF THE DRAWINGS

The invention will become apparent by referring to the following detailed description of a preferred embodiment with reference to the accompanying drawings, wherein.

DETAILED DESCRIPTION OF THE INVENTION

Figure 1:
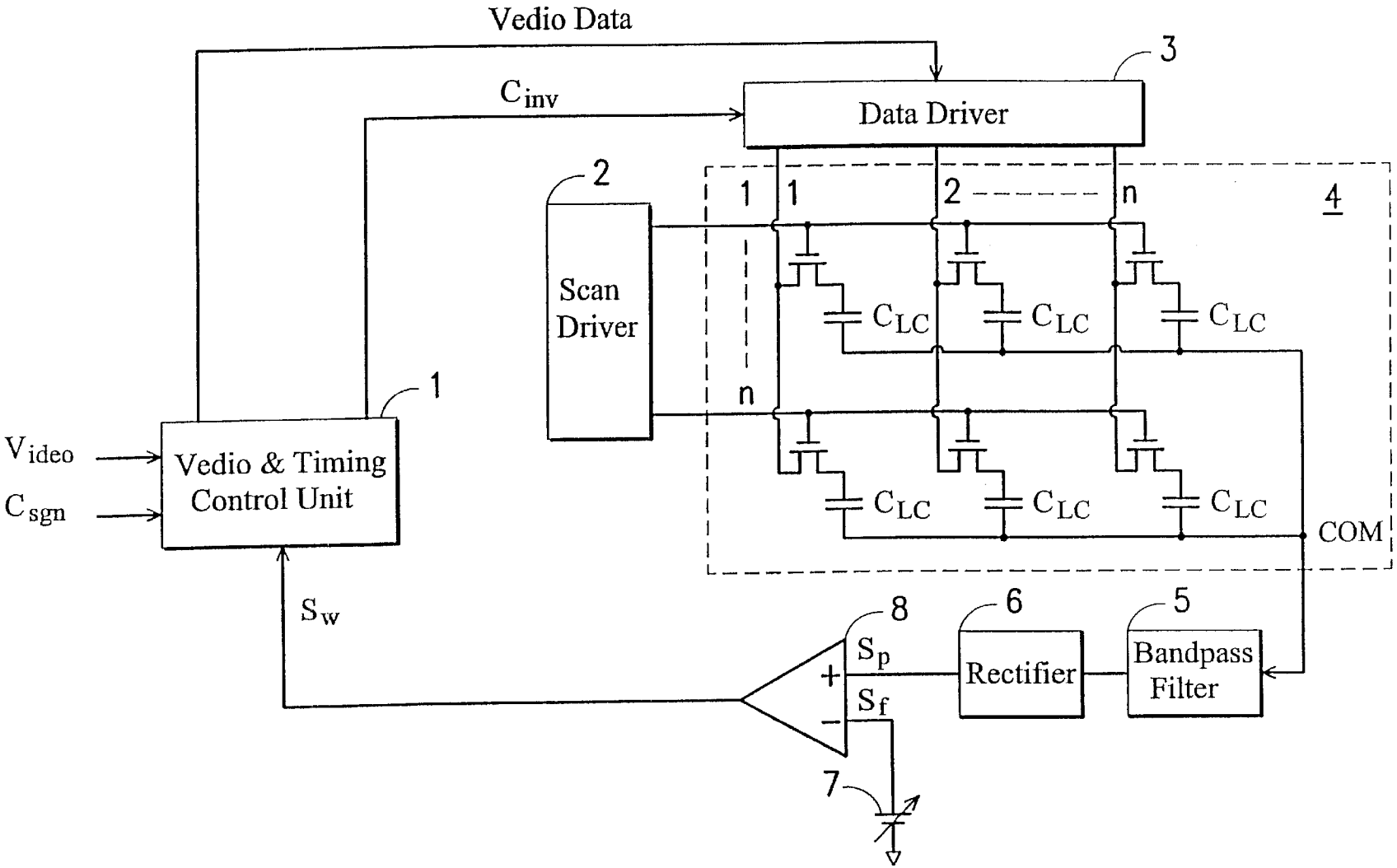
FIG. 1 is a schematic diagram of a system configuration of the invention.

Refer to FIG. 1, a schematic diagram of the system configuration. In FIG. 1, in addition to the conventional components of a video and timing control unit 1, a scan driver 2, a data driver 3, and a display circuit 4, the system adds a bandpass filter 5, a rectifier 6, an adjustable device 7, and a comparator 8. As shown in FIG. 1, the video and timing control unit 1 receives a video signal Video and a control signal Csgn including the external signals of a horizontal signal H, a vertical signal V, a clock signal CLK, and an enable signal. The video and timing control unit 1 outputs a control signal (not shown) to the scan driver 2 and the data driver 3 based on the control signal, thereby outputting the video signal video data and an inversion control signal Cinv to the data driver 3. The signals are subjected to the display circuit 4 so as to produce an output pattern. This output pattern is compared with a reference of the comparator 8 through the bandpass filter 5 and the rectifier 6. When the comparison discovers a flicker with a low-frequency timing pattern (about below 40 Hz), which cannot be withstood by human eyes, the comparator 8 outputs a switch signal Sw to the video and timing control unit 1 in order to output an control signal Cinv of one of the other predetermined inversions other than the original inversion used. The low-frequency timing pattern is a pattern periodcally appearing in the form of alternatively positive and negative step (a cycle including a positive and negative step) and having the frequency depending on the location used and the application. However, the center voltage value Sp of the pattern is not fixed but is changed by the pattern of the inversion technique used. As the changed voltage value Sp passes through the rectifier 6 to produce a DC voltage value over the reference input to the comparator 8 from an input signal Sf of the adjustable device 7, another inversion control signal is outputted for changing the inversion technique used to the data driver 3. The adjustable device 7 can be any adjustable active device or passive device, such as an adjustable resistor, capacitor, MOS, or FET.

Figure 3:
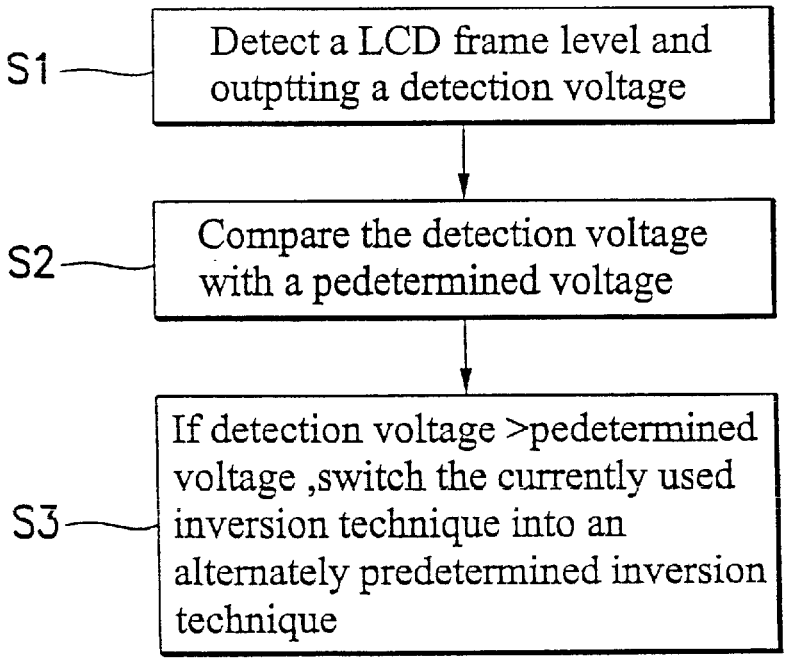
FIG. 3 is a flowchart of the operation of the invention.

Refer to FIG. 3, an operation flowchart of the invention. In FIG. 3, the operation method includes: detecting the display flicker level and producing a detection voltage (S1); comparing the detection voltage with a predetermined voltage (S2); automatically switching to an alternately predetermined display flicker processing technique if the detection voltage is greater than the predetermined voltage (S3).

Figure 2:
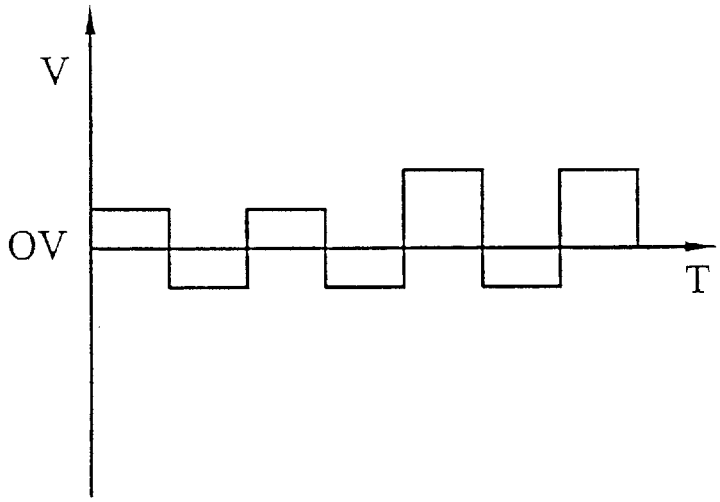
FIG. 2 is a diagram of a specific signal pattern to be detected according to the invention.

As shown in FIG. 3, also referring to FIGS. 1 and 2, the details are described as follows. Firstly, in step S1, the detection of a specific pattern on the common electrode COM is performed by the bandpass filter 5 and the rectifier 6. Then, in step S2, an abstracted voltage value from the specific pattern passed through the filter 5 and the rectifier 6 is inputted into the comparator 8 and compared with a predetermined voltage value from the adjustable device 7. Finally, in step S3, when the comparison result appears on that the abstracted voltage value is greater than the predetermined voltage value, the comparator 8 outputs a conversion control signal Sw so that the unit 1 outputs another inversion control signal Cinv so as to automatically switch to the inversion technique corresponding to the signal Cinv, which is predetermined and stored within the unit 1 to process the flicker. The switching of the inversion techniques is described in detail as shown in the following FIG. 4.

Figure 4:
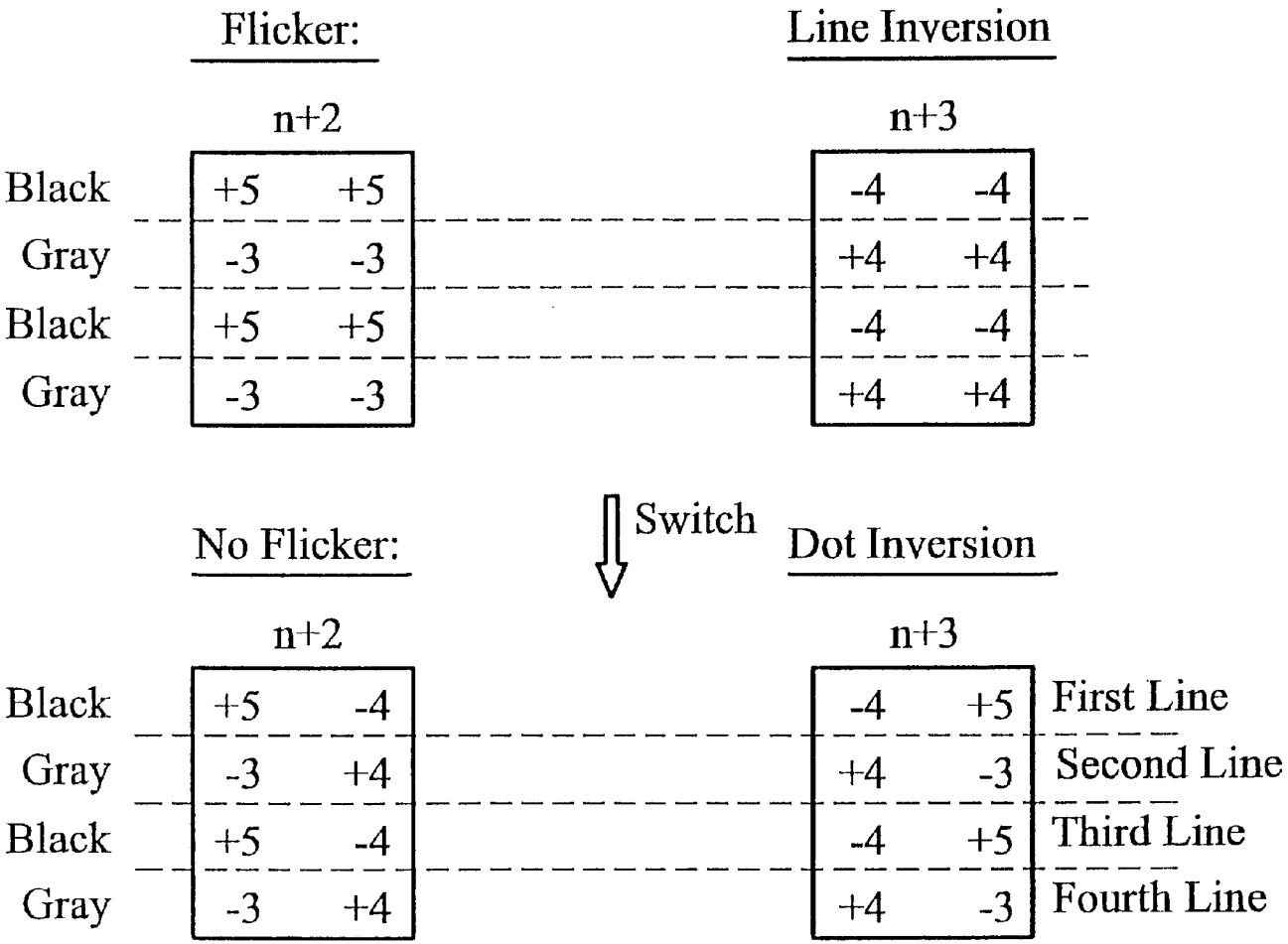
FIG. 4 is a diagram of the description example of FIG. 3 according to the invention.

In FIG. 4, an embodiment of switching a line inversion technique to a dot inversion technique. As shown in FIG. 4, a system with the line inversion technique shows a pattern with black line and gray line in turn in which each pixel of the line has 0.5V dc voltage. The n+2 frame has a black line voltage +5V and gray line −3V while the n+3 frame has a black line voltage −4V and a gray line +4V. Therefore, the n+2 frame is illuminated by the driving voltage +5V and −3V and the n+3 frame is illuminated by the driving voltage +4V and −4V. However, the total driving voltage, compared the n+2 frame with the n+3 frame, is different, thus incurring the flicker effect when switching from the n+2 frame to the n+3 frame. The difference of the two total driving voltages is coupled to the common electrode COM through the capacitors (as shown in FIG. 1), the electrode COM is coupled into a step signal with several 10 Hz(as shown in FIG. 2).

The step signal has a dc voltage after passing through the bandpass filter 5 and the rectifier 6. The dc voltage changes its value up or down depending on the flicker level. When comparing the dc voltage and the output voltage of the adjustable device 7, the flicker is over the accepted limit if the dc voltage is greater than the output voltage of the adjustable device 7. At this point, the comparator 8 outputs the control signal Sw to make the system switch from the line inversion technique to the dot inversion technique. That is, the n+2 frame has a black dot voltage +5V and −4V and a gray dot voltage −3V and +4V while the n+3 frame has a black dot voltage +5V and −4V and a gray dot voltage −3V and +4V, as shown in FIG. 4. The total driving voltage whether or not the n+2 frame or in the n+3 frame is the same. This makes the frame stop flickering and the common electrode COM no longer couple the step signal. Accordingly, the invention can actually eliminate the flicker automatically.

Although the invention has been described in its preferred embodiment, it is not intended to limit the invention to the precise embodiment disclosed herein. Those who are skilled in this technology can still make various alterations and modifications without departing from the scope and spirit of this invention. Therefore, the scope of the invention shall be defined and protected by the following claims and their equivalents.

What is claimed is:

1. A method for auto-improving display flicker, comprising the steps of:

detecting a level of display flicker and producing a detection voltage;

comparing the detection voltage with a predetermined voltage; and automatically switching to a predetermined display flicker processing technique if the detection voltage is greater than the predetermined voltage, wherein the predetermined display flicker processing technique is one, other than currently used, selected from the group of dot inversion, line inversion, column inversion, n line inversion and n column inversion.

2. The method of claim 1, wherein a magnitude of the detection voltage is varied depending on the predetermined display flicker processing technique to be selected.

3. The method of claim 1, wherein the magnitude of the predetermined voltage is adjustable according to the predetermined display flicker processing technique to be selected.

4. A system for auto-improving display flicker, comprising:

a display circuit for supplying a signal pattern;

a display detecting device for detecting the signal pattern and outputting a detection voltage;

a comparator for comparing the detection voltage with a predetermined voltage value and outputting a switch control signal when a value of the detection voltage is greater than the predetermined voltage value; and a video and timing control signal into a predetermined display flicker processing technique, wherein the predetermined display flicker processing technique is one, other than currently used, selected from the group of dot inversion, line inversion, column inversion, n lines inversion and n columns inversion.

5. The system of claim 4, wherein the magnitude of the detection voltage is varied depending on the predetermined display flicker processing technique to be selected.

6. The system of claim 4, wherein the magnitude of the predetermined voltage is adjustable according to the predetermined display flicker processing technique to be selected.

* * * * *